US008332965B1

(12) United States Patent
Ryer

(10) Patent No.: US 8,332,965 B1
(45) Date of Patent: Dec. 18, 2012

(54) MODESTY HOSPITAL GOWN

(76) Inventor: Ralada Ryer, Walnut Creek, CA (US)

( * ) Notice: Subject to any disclaimer, the term of this patent is extended or adjusted under 35 U.S.C. 154(b) by 82 days.

(21) Appl. No.: 13/066,924

(22) Filed: Apr. 28, 2011

Related U.S. Application Data

(63) Continuation-in-part of application No. 12/459,957, filed on Jul. 11, 2009, now abandoned.

(51) Int. Cl.
*A41B 9/00* (2006.01)

(52) U.S. Cl. ..... 2/114; 2/59; 2/46; 2/72

(58) Field of Classification Search ..... 2/114, 113, 2/115, 72, 46, 67, 69, 914
See application file for complete search history.

(56) References Cited

U.S. PATENT DOCUMENTS 3,129,432 A * 4/1964 Belkin ..... 2/114
3,824,625 A * 7/1974 Green ..... 2/114
3,977,025 A * 8/1976 Horan ..... 2/114

* cited by examiner

*Primary Examiner* — Alissa Tompkins
(74) *Attorney, Agent, or Firm* — Robert Samuel Smith

(57) ABSTRACT

A hospital garment comprising a substantially rectangular main panel and a smaller flap panel seamed to an end of a free edge of the main garment. In one position, the flap panel extends across the back of the patient and is connected by ribbons to the main panel so as to conceal the buttocks and back of the patient's leg and in another orientation of the flap panel, the flap panel does not conceal the buttocks and back of the patient's leg.

5 Claims, 2 Drawing Sheets

MODESTY HOSPITAL GOWN

EARLIER FILED APPLICATIONS

This application is a Continuation-in-Part of application Ser. No. 12/459,957 filed Jul. 11, 2009 now abandoned from which priority is claimed.

FIELD OF THE INVENTION

This invention relates to hospital gowns and particularly to a gown that addresses the modesty requirements of the patient.

BACKGROUND AND INFORMATION DISCLOSURE

The typical hospital gown is essentially a sheet with sleeves that is stretched across the patients front (chest and abdomen) and is wrapped around the body.

A common source of stress for hospital patients is occasioned by the patient's desire to maintain modesty and decorum during walks through hospital corridors during his convalescent period.

There is the additional inconvenience of having to pass medicines or devices through openings in the gown such as stethoscopes, medicines and other appurtenances related to his hospitalization.

Typically, the patient is required to open the rear of the gown numerous times during the day and rejoin the ribbons each time.

Numerous disclosures have appeared which are intended to accommodate the needs that the patient encounters on a daily-hourly basis.

U.S. Pat. No. 7,181,773 discloses a hospital gown with a large frontal area covered by a flap that is intended to provide access to the chest area of the patient. This gown has the typical back construction where the edges of the sheet wrapped around the chest meet along the back (spinal column).

U.S. Pat. No. 7,293,295 discloses a garment having a vest-like construction with a pair pockets on each side of the front of the vest. The pockets are designed for holding containers.

U.S. Pat. No. 7,418,741 discloses a garment including a jacket part and a pants part that is suitable for street wear. The jacket and pants each have pockets for storing containers of liquid according to the medical protocol. Openings in the pocket enable communication of the liquid container with the patient's body.

U.S. Pat. No. 7,424,750 discloses a gown made up of a single front panel and a single back panel. releaseably connected together along a shoulder seam by a row of releaseable connectors. The gown has a connection device that allows opposing sections of the rear panel to be connected together in a location in front of the person wearing the gown. None of these arrangements provide the convenient accessibility combined with protection of privacy to the rear of the patient as provided by the present invention.

SUMMARY OF THE INVENTION

It is an object of this invention to provide a hospital gown that protects the modesty of a patient particularly when the patient is out of bed and walking in the hospital corridors.

It is another object that the patient or attendees to the patient have convenient access to private parts of the patient's body as required for treating the patient and permitting toilet activities.

This invention is directed toward a hospital gown of fabric comprising a "main panel" with two sleeves and a "flap" panel. The substantially rectangular "main" panel comprises a top edge parallel to a bottom edge and two parallel side (meeting) edges The main panel extends from the neck toward the ankles and wraps around the patient so that the two "back" (side) edges of the main panel may meet along the spine of the patient The top edge of the main panel has a "v neck" cutout. The ends of the "v cutout" are joined together to enclose the patient's neck The top edge on each side of the "v-neck" cutout is seamed to an edge of one sleeve Each sleeve also comprises two opposite edges joined by snap fasteners to secure each sleeve around a respective arm.

The four edges of the flap panel comprise:

a "seam" edge seamed to an entire length of one "back" edge of the main panel;

a "bottom" edge that is continuous with the bottom edge of the main panel;

a "free edge" opposite and parallel to the "seam" edge but only half as long as the "seam" edge;

a "top edge" meeting the top end of the "seam" edge at an obtuse angle and meeting the top end of the "seam edge" at an acute angle.

One end of a "joining" ribbon is secured to a corner of the "flap panel

A "first body" ribbon and a "second body" ribbon each attached to the front of the main panel, spaced from one another, When complete exposure of the patient's back and back of legs is required, the "flap" panel is folded back away from along the seam line and secured by the "joining" ribbon continuing around to the patient's front where it is tied to the nearest ribbon attached to the main panel near the patient's breast. The meeting edges of the main panel are thereby separated from one another so that the patient's back and back of legs are exposed. The "flap" panel is thereby laid open.

When the patient desires to cover his back, the "flap" panel is extended from the seam line to across the meeting line. The tie ribbon is extended from the flap panel in an enclosing direction around the body and secured to the second body ribbon attached the front of the gown.

An opening in the chest area of the main panel provides access to appropriate areas of the patent body. and may comprise pockets accessible from outside the garment.

DETAILED DESCRIPTION OF PREFERRED EMBODIMENTS

Figure 1:
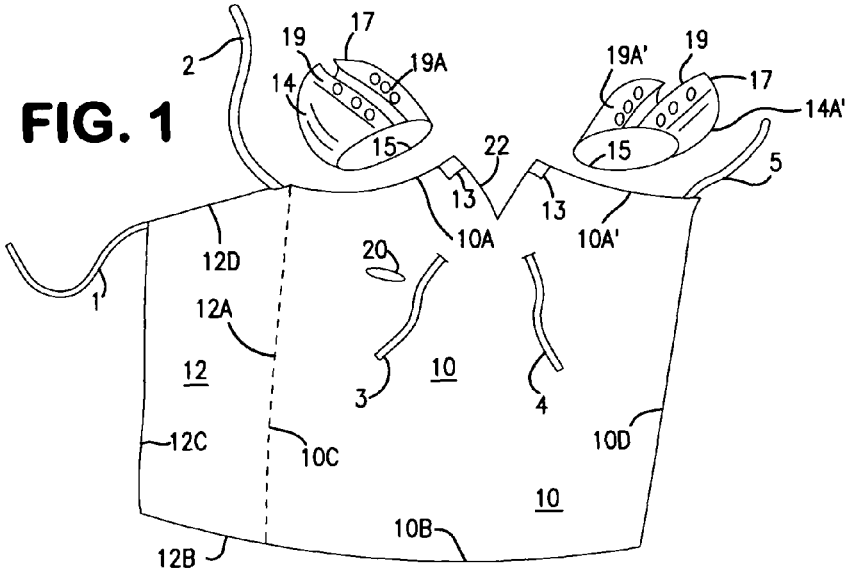
FIG. 1 shows the laid out panels of the garment with panels detached.

Turning now to a discussion of the drawings, FIG. 1 shows the laid out gown of this invention comprising a fabric main panel 10 seamed on one edge to a "flap" panel 12 and two sleeves 14.

The "main panel" 10 is substantially rectangular. and comprises a top edge 10A, 10A' parallel to a bottom edge 10B and a seam edge 10C parallel to a side edges 10D.

The main panel 10 extends from the neck toward the ankles and wraps around the patient so that the side edge 10D parallel to the seam edge 10C of the main panel 10 meet along the spine of the patient when the patient wishes to conceal his/her back The top edge 10A, 10A' of the main panel 10 has a "v neck" cutout 12 midway between the ends of the top edge 10A, A'. The ends of the "v cutout" 12 are tied together by a pair of "neck" ribbons 2, 5 when required to enclose and secure the patient's neck in the "v" cutout 12.

A pair of hook and loop patches 13 temporarily holds the v opening 12 around the neck as an aid to tying the neck ribbons 2,5 together across the back of the neck.

Segment 10A and segment 10 A' of the top edge 10AA' on each side of the "v-neck" cutout 12 are contoured to enable seaming one shoulder section 10A of the top edge 10AA' to first sleeve 14A and to enable seaming another section 10A' of the top edge 10AA' to second sleeve 14A'.

Each of sleeves 14A, and 14A' has a shoulder opening 15 and an arm opening 17 at opposing ends of the respective sleeve 14A, 14A' arranged for positioning an arm through the respective sleeve.

An edge of each shoulder opening 15 of each sleeve 14A 14A' is contoured for seaming to a respective mating section of the top edge 10A, 10A' of the main panel 10.

A parting line 19 in each sleeve 14, 14A' extends from the respective shoulder opening 15 to the respective arm opening 17. Each edge 19 of the parting line is joinable to the opposite edge by snap fasteners 19A'.

The flap panel 12 comprises:

a "flap seam" edge 12A seamed to an entire length of one side edge 10C of the main panel 10;

a flap "bottom" edge 12B having one end perpendicularly meeting a lower end of the "flap "seam" edge 12A;

a "flap free" edge 12C parallel to the "flap seam" edge 12A but only half as long as the "flap seam" edge 12A:

a "flap bottom edge 12B meeting an end of the bottom edge 10B of the main panel 10;

a 'flap top" edge 12D meeting the top end of the "flap free" edge 12C at an obtuse angle and meeting the top end of the "flap seam" edge 12A at an acute angle.

One end of a "joining" ribbon 1 is secured to the corner where the "flap top" edge 12D and the 'flap free" edge 12C meet.

A "first body" ribbon 3 and a "second body" ribbon 4 each have an end secured to the main panel 10, spaced from one another, and equidistant from the "top" edge 10AA' of the main panel 10. The attached ends of the "first and second body" ribbons 3,4 are each secured to respective areas of the main panel 10 adjacent to the right and left breast of the patient.

One "neck" ribbon 2 is shown having one end attached to the upper end of the meeting of seam edges 10C and 12A and another "neck" ribbon 5 is shown attached to the upper end of free edge 10 D of the main panel. "Neck" ribbons 2 and 5 are always tied together to cover the patient's upper back and secure the cutout 22 around the back of the patient's neck.

Figure 2:
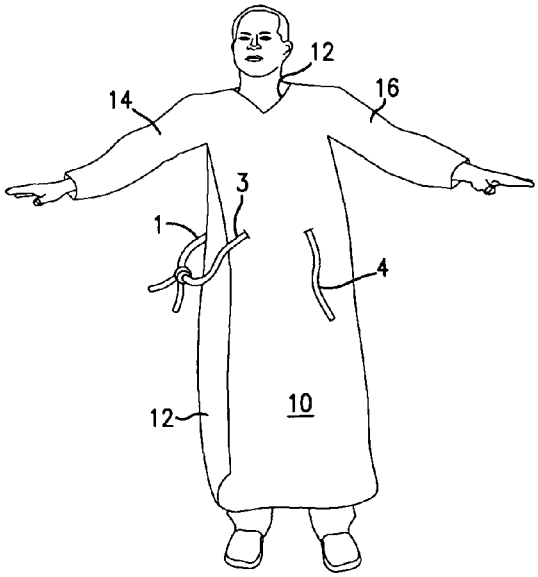
FIG. 2 is a front view of the patient 26 wearing the garment 11 when the back is covered.

As shown in FIG. 2 (front) and 3 (back), when greatest exposure of the patient's back and back of legs is required, the "flap" panel 12 is folded back in a first direction away from along the seam line 12A and secured in this (folded back) position by the "joining" ribbon 1 continuing around to the patient's front where it is tied to the nearest (first body) ribbon 3 attached to the main panel 10 near the patient's right breast. The meeting edges 10C and 10D of the main panel are thereby held separated from one another so that the patient's back and back of legs are exposed. The "flap" panel 12 is in a completely "open" laid back position.

Figure 4:
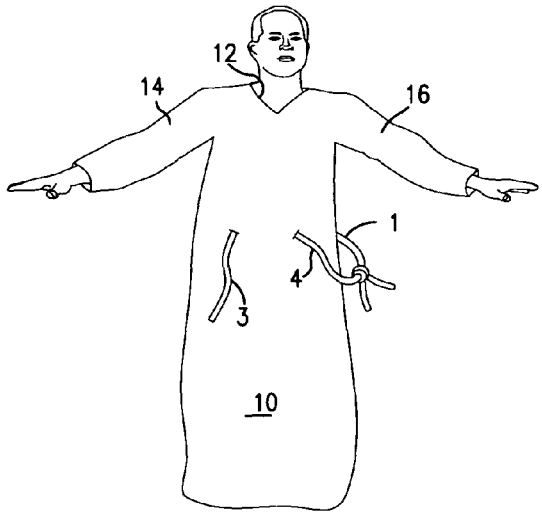
FIG. 4 is a front view when the back is uncovered. The flap is laid back and the meeting edges have been separated
Figure 3:
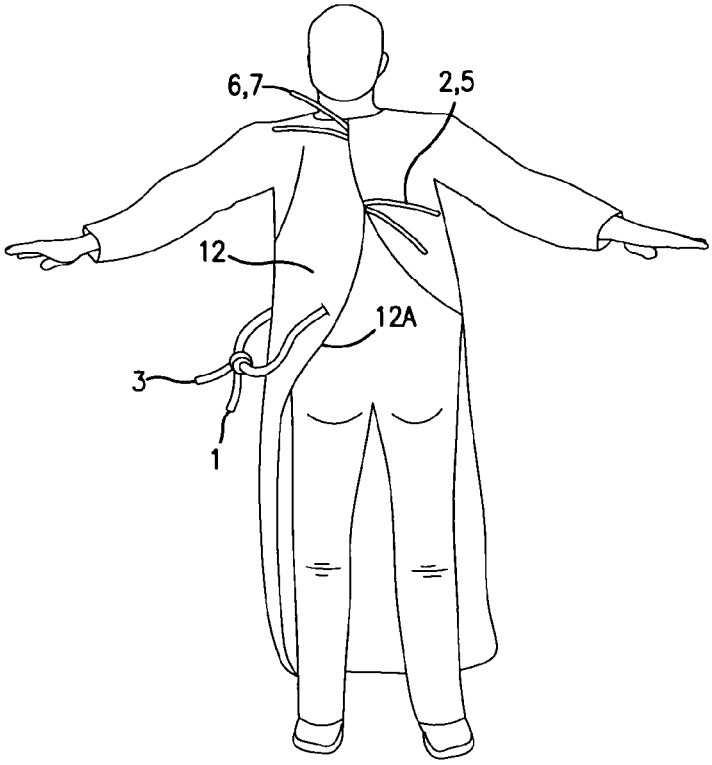
FIG. 3 shows a rear view of FIG. 2 where the "back" edges of the main panel come together and the flap panel is drawn over the back edges of the panel.
Figure 5:
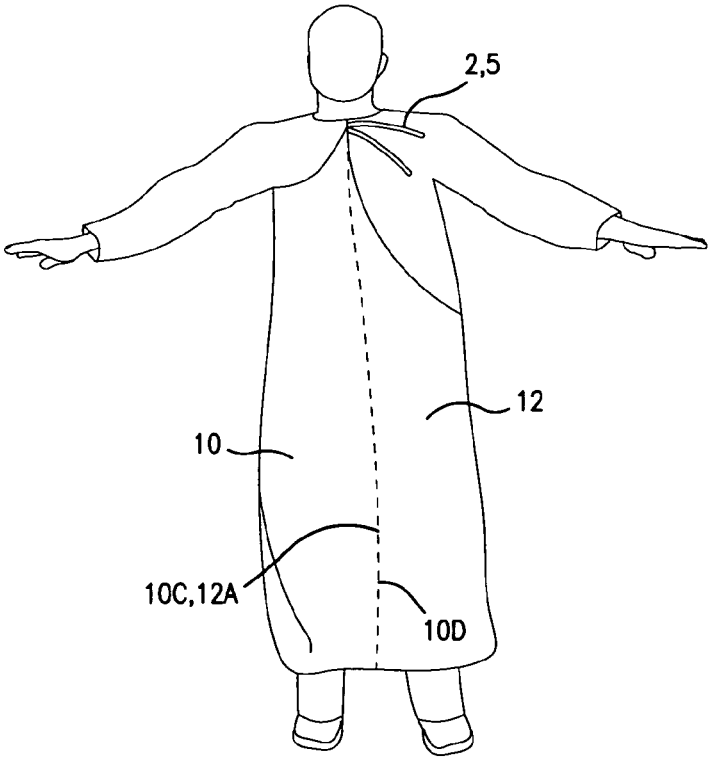
FIG. 5 is a rear view when the back is uncovered. The flap has been folded back and maintained by tying the tie ribbon

As shown in FIGS. 4 (front) and FIG. 5 (back) when the patient desires to cover his back such as when strolling in the hospital corridor, the "flap" panel 12 is extended from the seam line 12A, 10C, across the meeting line. 10D. The "joining" ribbon 1 is further extended from the flap panel in an enclosing direction around to the front of the body and secured to the "second body" ribbon 4 attached to the front (breast) area of the main panel (the front of the gown).

The gown is thereby wrapped completely around the patient and closure of the gown across the back of the legs and buttock is ensured as shown in FIG. 5.

An opening 20 in the chest area of the main panel 10 provides access to appropriate areas of the patent body for devices such as a stethoscope, transfusion device or thermometer.

Where required, these openings include pockets accessible from outside the garment.

There has been described a gown, particularly targeted for use in a hospital, which features a flap that, when tied in one position, wraps around the body and: covers the back allowing the patient to move around the wearer with the body completely covered, including personal areas of the body when the patient wishes to move through out the hospital; or exposes the back including personal areas of the body when access to this region is required.

Variations and modifications of the gown may be contemplated after studying the pictures and reading the description that are within the scope of the invention I therefore wish to define the scope of the invention by the appended claims.

What is claimed is:

1. A hospital gown comprising:

a main panel dimensioned for wear by a patient and extending from a neck downwardly toward ankles of said patient and for wrapping around said patient; said main panel being substantially rectangular and having a top edge, a bottom edge, a side edge, and a seam edge; said top edge is parallel to said bottom edge and said side edge is parallel to said seam edge; said seam edge and said side edge extend between said bottom edge and said top edge forming the substantially rectangular main panel;

a flap panel having a flap seam edge, is attached along an entire length of the seam edge of the main panel and extends outwardly from the main panel; said flap panel has a flap bottom edge having one end perpendicularly meeting a lower end of said flap seam edge and a flap free edge that is parallel to said flap seam edge; said flap free edge is shorter than said flap seam edge, and has one end perpendicularly meeting an end of said bottom edge of said main panel; a flap top edge connects to a top end of said flap free edge at an obtuse angle and connects the top end of said flap seam edge at an acute angle;

a cut out is formed in said top edge of said main panel and is centered between ends of said top edge;

a first neck ribbon having one end attached adjacent to a junction of said top edge and said seam edge of said main panel; a second neck ribbon having one end attached adjacent to a junction between an end of said top edge and said side edge of said main panel; whereby said garment is secured to the neck of said patient when a neck of said patient is positioned in said cutout and ends of said cutout are secured together by said first and second neck ribbons; and a joining ribbon having one end secured to a corner where said flap top edge and said flap free edge meet;

a first chest ribbon and a second chest ribbon are located and secured to respective areas of said main panel corresponding to right and left breasts of said patient and are located equidistant from said top edge of said main panel; whereby a back of said patient is exposed when said patient is wrapped in said hospital gown with said patients back secured in said cutout and said flap is pulled in a direction to expose said back with said joining ribbon tied to said first chest ribbon; and whereby a back of said patient is covered when said patient is wrapped in said hospital gown with said patient's neck secured in said cutout and said flap is pulled in a direction to cover said back with said joining ribbon tied to said second chest ribbon.

2. The hospital gown of claim 1 comprising:

a first sleeve and a second sleeve;

said first sleeve and said second sleeve each having a shoulder opening and an arm opening located at opposing ends of each respective sleeve and arranged for positioning an arm there through;

each of said shoulder openings of each sleeve having an edge contoured for seaming to a respective right and left shoulder mating section of said top edge of said main panel;

each sleeve having a parting line extending from a respective shoulder opening to a respective arm opening;

said edges of said opposing parting lines of each sleeve joinable together by snap fasteners;

a first shoulder section of said top edge is seamed to said one contoured edge of said first sleeve and a second shoulder section of said top edge is seamed to said contoured edge of said second sleeve.

3. The hospital gown of claim 1 comprising; at least one opening in said main panel.

4. The hospital gown of claim 3, wherein at least one of said openings includes a pocket accessible from outside the hospital gown.

5. The hospital gown of claim 1, comprising a pair of hook and loop patches secured to the main panel and arranged for holding said cutout around a neck of a patient to aid tying said first and second neck ribbons together across a back of said patients neck.

* * * * *

UNITED STATES PATENT AND TRADEMARK OFFICE

CERTIFICATE OF CORRECTION

PATENT NO. : 8,332,965 B1
APPLICATION NO. : 13/066924
DATED : December 18, 2012
INVENTOR(S) : Ralda Agatha Ryer It is certified that error appears in the above-identified patent and that said Letters Patent is hereby corrected as shown below:

Title page, item [76], change Inventor to:

"Ralda Agatha Ryer
1731 Holland Circle
Walnut Creek, CA. 94597"

Signed and Sealed this
Fifth Day of March, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 8,332,965 B1
APPLICATION NO. : 13/066924
DATED : December 18, 2012
INVENTOR(S) : Ralda Agatha Ryer It is certified that error appears in the above-identified patent and that said Letters Patent is hereby corrected as shown below:

In the Claims

In Claim 1, on column 4, line 57, the term “a cut out” is hereby corrected to read “a cutout”.

Signed and Sealed this
Nineteenth Day of May, 2015

Michelle K. Lee

Michelle K. Lee
*Director of the United States Patent and Trademark Office*